US005527108A

United States Patent [19]

Miller

[11] Patent Number: 5,527,108

[45] Date of Patent: Jun. 18, 1996

[54] APPARATUS FOR CHARGING A PUMPING DEVICE

[75] Inventor: Grover W. Miller, Peninsula, Ohio

[73] Assignee: A-1 Concrete Leveling, Inc., Akron, Ohio

[21] Appl. No.: 378,188

[22] Filed: Jan. 25, 1995

[51] Int. Cl.[6] ..... B01F 15/02

[52] U.S. Cl. ..... 366/157.3; 366/38; 366/195

[58] Field of Search ..... 366/27, 38, 33, 366/34, 37, 50, 51, 52, 190, 196, 195, 157.2, 157.3, 157.4, 156.1, 61; 417/900

[56] References Cited

U.S. PATENT DOCUMENTS

| | | | |
|---|---|---|---|
| 1,933,469 | 10/1933 | Aylward | 94/39 |
| 1,943,914 | 1/1934 | Fiock | 61/35 |
| 1,969,324 | 8/1934 | Poulter | 61/63 |
| 1,974,123 | 9/1934 | Poulter | 61/63 |
| 2,074,756 | 3/1937 | Poulter | 94/39 |
| 2,286,761 | 6/1942 | Poulter | 94/39 |
| 2,851,257 | 9/1958 | Morgan | 366/195 |
| 3,140,801 | 7/1964 | Delligatti | 417/900 |
| 3,929,416 | 12/1975 | Tanaka | 366/195 |

*Primary Examiner*—Robert W. Jenkins
*Attorney, Agent, or Firm*—Roger D. Emerson

[57] ABSTRACT

An apparatus used to charge a pumping device with a slurry mixture such as cement is provided. A hollow funnel-shaped receptacle is equipped with a rotating shaft. Extending from the shaft are angled blades which keep the slurry mixture thoroughly mixed while pushing it toward the pumping device. The action of the blades in concert with gravitational forces charge a receiving chamber of a pumping device.

20 Claims, 4 Drawing Sheets

APPARATUS FOR CHARGING A PUMPING DEVICE

FIELD OF INVENTION

This invention pertains generally to the art of mixing and pumping slurry mixtures, and more specifically to a supercharger apparatus for charging a pumping device with cement or other slurry mixture.

DESCRIPTION OF RELATED ART

In the art, misaligned concrete, pavement or other such structure have been moved to more advantageous positions by pumping suitable material behind or on one side of the structure. The material used for this purpose may consist of a slurry mixture of various components dispersed in water. The material is usually fed into a pumping device then forced through a transporting means to the desired location. It is the charging of such pumping devices that encompasses the scope of the present invention.

Some pumping devices are charged through the action of pressurized air such as is described in U.S. Pat. Nos. 2,074,756 or 2,286,761 both the J. W. Poulter. Such charging methods are complicated by hoses, valves, gauges, and the like.

In a pumping device disclosed in U.S. Pat. No. 1,969,324 to J. W. Poulter, mixing paddles force the slurry into a charging chamber then the pump is presumably charged by gravity. Gravity based charging devices may allow the components of the slurry to separate or may not adequately charge the pumping device.

The present invention contemplates a new and improved charging apparatus which is simple in design, effective in use, and overcomes the foregoing difficulties and others while providing better and more advantageous overall results.

SUMMARY OF THE INVENTION

In accordance with the present invention, a new and improved apparatus which charges a pumping device with cement or other slurry material is provided.

More particularly, in accordance with the present invention, the charging apparatus comprises a rotatable shaft located within a hollow receptacle. Extending from the shaft are blades which serve to push the slurry mixture toward the pumping device.

According to one aspect of the invention, the charging apparatus comprises a hollow receptacle for receiving a slurry mixture, said receptacle being symmetric about a central axis and having first and second concentric edges, said first edge communicating with said pumping device; a shaft being coincident with said central axis, said shaft having first and second ends, said first end being received within said receptacle, said second end extending beyond said second edge, said shaft comprising a plurality of protrusions extending radially therefrom; and, a rotating means for rotating said shaft.

According to another aspect of the invention, the hollow receptacle comprises a conical funnel-like configuration having a vertical central axis and an inwardly sloped wall.

According to another aspect of the invention, the plurality of protrusions which extend from the shaft comprises two first blades. The blades are oppositely pitched with respect to an angle each of the blades makes with the central axis. The first blades are received with the receptacle, and occupy opposing positions on the shaft. The distal ends of the first blades are sloped to correspond to the slope of the inwardly sloped wall of the receptacle.

According to another aspect of the invention, the plurality of protrusions which extend from the shaft further comprises two second blades. The blades are oppositely pitched with respect to an angle each of the blades makes with the central axis. The second blades are received within the receptacle, between the first blades and the second edge, and occupy opposing positions on the shaft. The positions of the second blades are offset by an angle with respect to the positions of the first blades.

According to another aspect of the invention, the first end of the shaft is equipped with a helical appendage.

According to another aspect of the invention, the apparatus is equipped with a feed tube through which the slurry enters the receptacle.

According to another aspect of the invention, the apparatus further comprises a rigid screen. The screen is fixed to the shaft between the second blades and the second edge and is rotatable therewith.

According to another aspect of the invention, the apparatus comprises a hinged arm allows removal of the shaft from inside the receptacle for removal, maintenance, or cleaning of the elements attached to the shaft.

According to another aspect of the invention, the apparatus comprises a secondary feed tube extending from the wall of the receptacle. The wall of the receptacle has an opening therein which communicates with the secondary tube.

One advantage of the present invention is its simplicity of design. The charging apparatus uses the motion of the protrusions extending from the rotating shaft in concert with the force of gravity to charge the pumping device.

Another advantage of the present invention is its ease of cleaning. The shaft is attached to a hinged arm which allows access to all elements for cleaning and maintenance purposes.

Another advantage of the present invention is its ease of varying amounts of slurry mixture delivered to the pumping device. The flow of slurry mixture to the charging apparatus can be easily interrupted. Because the slurry mixture is delivered pre-mixed, only the desired quantity of material is required to pass through the charging device.

Still other benefits and advantages of the invention will become apparent to those skilled in the art upon a reading and understanding of the following detailed specification.

BRIEF DESCRIPTION OF THE DRAWINGS

The invention may take physical form in certain parts and certain arrangement of parts. A preferred embodiment of these parts will be described in detail in the specification and illustrated in the accompanying drawings which form a part of this disclosure and wherein.

DESCRIPTION OF THE PREFERRED EMBODIMENT

Figure 1:
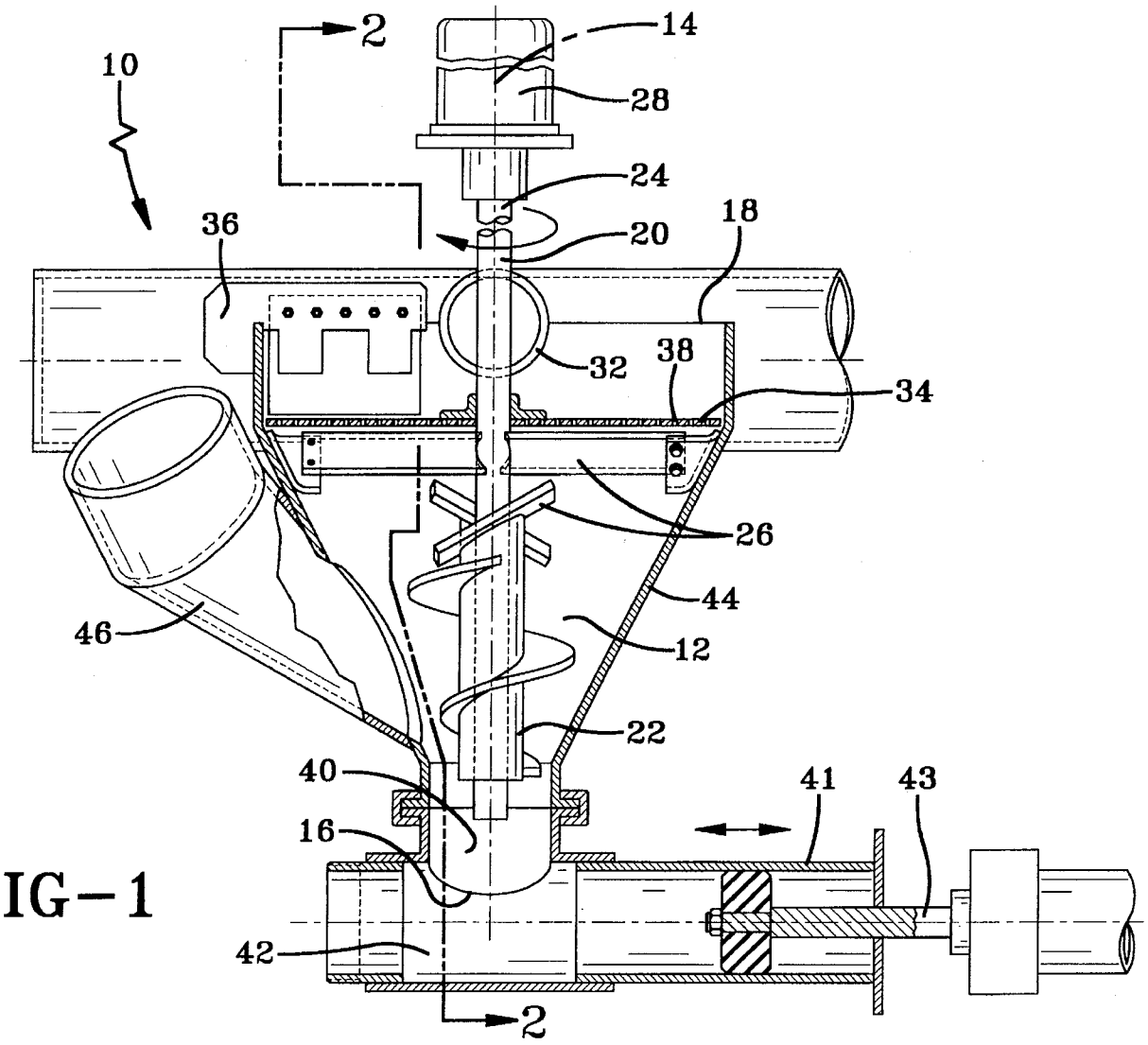
FIG. 1 shows a front view, partially broken away, of the charging apparatus according to the invention.

Referring now to the drawings, which are for the purposes of illustrating a preferred embodiment of the invention only, and not for purposes of limiting the invention, FIG. 1 shows a charging apparatus 10 according to the present invention. The charging apparatus 10 comprises a hollow receptacle 12 having a central axis 14, a first edge 16, and a second edge 18. A rotatable shaft 20, coincident with the central axis 14, comprises a first end 22, and a second end 24. The first end 22 is received within the receptacle 12 while the second end 24 extends beyond the second edge 18. Extending radially from the shaft 20 is a plurality of protrusions 26. A means for rotating 28 is located at the second end 24 of the shaft 20.

Still with reference to FIG. 1, during operation of the charging apparatus 10, a slurry mixture (not shown) comprising finely divided particles suspended in a carrying fluid, continuously enters the receptacle 12 through a feed tube 32. In a preferred embodiment, the slurry mixture passes through a rigid screen 34. The screen 34 is fixed to the shaft 20 and rotates therewith, occupying a position on the shaft 20 near the second edge 18 of the receptacle 12. A stationary scraper 36 straddles the second edge 18 and extends across the screen 34. As the screen 34 rotates, the slurry mixture is distributed across a first surface 38 of the screen 34 and passes therethrough. As the slurry mixture passes through the screen 34, it encounters the protrusions 26 which are also rotating with the shaft 20. The protrusions 26 serve to maintain the dispersement of particles in the slurry mixture while pushing the slurry mixture toward the first edge 16, thereby preserving the integrity of the slurry mixture throughout its passage through the receptacle 12.

The first edge 16 of the receptacle 12 comprises a passageway 40 which communicates with a pumping device 41. The charging apparatus 10 charges the pumping device 41 by forcing the slurry mixture through the passageway 40. The pumping device 41 comprises a receiving chamber 42 and a piston 43. The receiving chamber 42 receives the slurry mixture from passageway 40. The piston 43 advances to push the slurry mixture toward its destination. As the piston 43 retreats, the receiving chamber 42 is refilled with slurry mixture from passageway 40 and the piston 43 repeats its cycle. In a preferred embodiment, the central axis 14 is vertical and the receptacle 12 is conical, having an inwardly sloped wall 44. The charging apparatus 10 therefore cooperates with gravitational forces to charge the pumping device 41. The action of the protrusions 26 on the slurry mixture provide more efficient charging of the pumping device 41 than gravity alone.

In another embodiment of the invention, the slurry mixture is fed into the charging apparatus 10 through a secondary feed tube 46. The slurry mixture thereby bypasses the screen 34.

Figure 2:
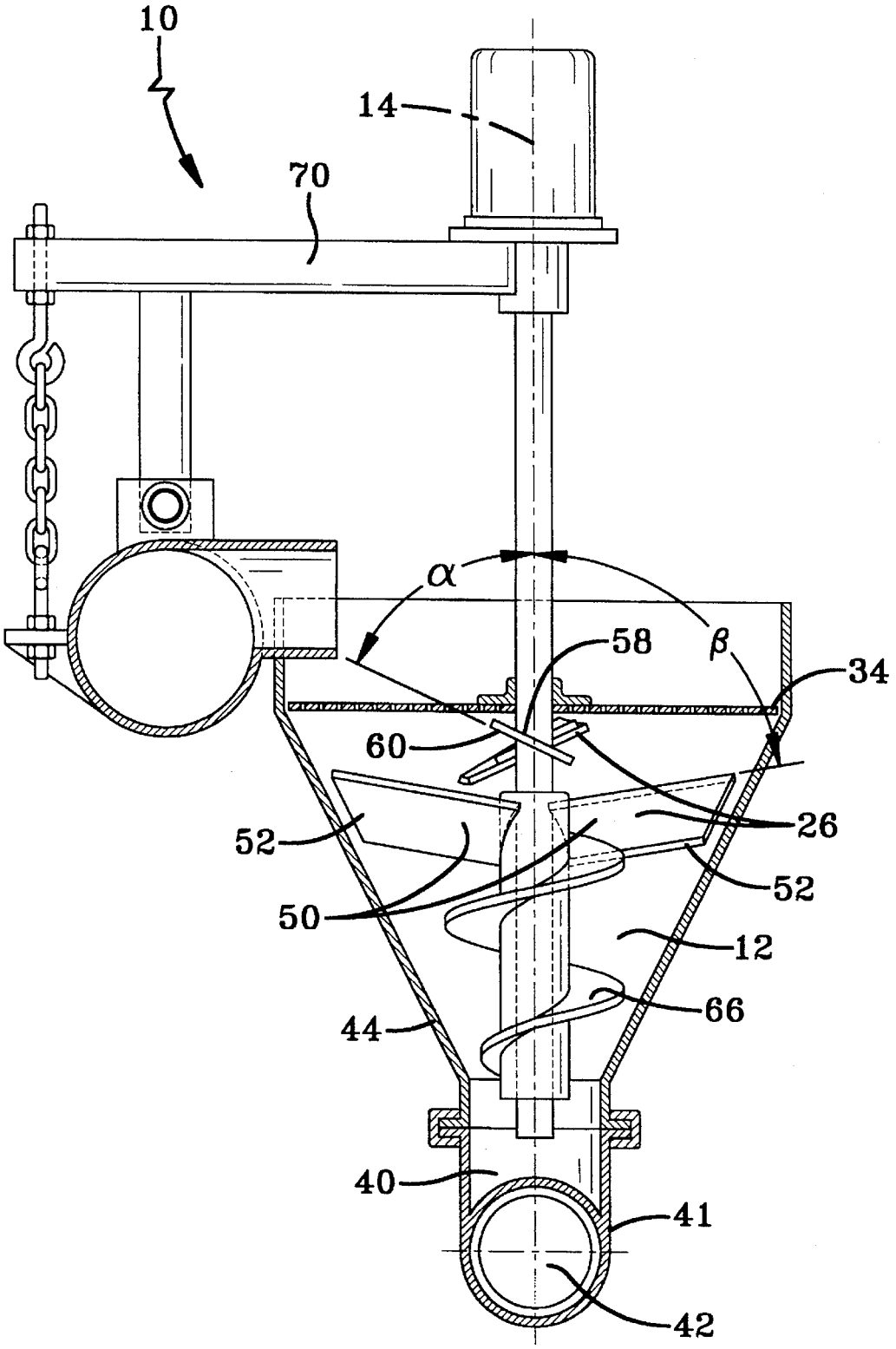
FIG. 2 shows a sectional view taken along the line 2—2 of FIG. 1.

Referring now to FIG. 2, the plurality of protrusions 26 comprise two first blades 50. The first blades 50 are located within the receptacle 12. The first blades 50 are oppositely pitched with respect to an angle $\beta$ each of the first blades 50 makes with the central axis 14. The first blades 50 occupy opposing positions on the shaft 20. The distal ends 52 are closely received to the receptacle wall 44 and are sloped to correspond therewith. Slurry mixture that encounters the first blades 50 is forced toward the passageway 40 by the angular pitch of the first blades 50.

The plurality of protrusions 26 further comprise two second blades 58. The second blades 58 are located within the receptacle 12 between the first blades 50 and the second edge 18. The second blades 58 are oppositely pitched with respect to an angle $\alpha$ each of the second blades 58 makes with the central axis 14. The second blades 58 occupy opposing positions on the shaft 20. In a preferred embodiment, the distal ends 60 of the second blades 58 are closely received to the screen 34. The slurry mixture that passes through the screen 34 encounters the second blades 58 whose angular pitch push the slurry mixture toward the first blades 50.

A preferred embodiment of the invention further comprises a helical appendage 66 which twists about the first end 22 of the shaft 20. The helical appendage 66 further serves to push the slurry mixture toward passageway 40 while providing mixing action to keep the slurry mixture components from separating. The helical appendage 66 also forces the slurry mixture into the pumping device 41 whenever the receiving chamber 42 is ready to be refilled.

Figure 3:
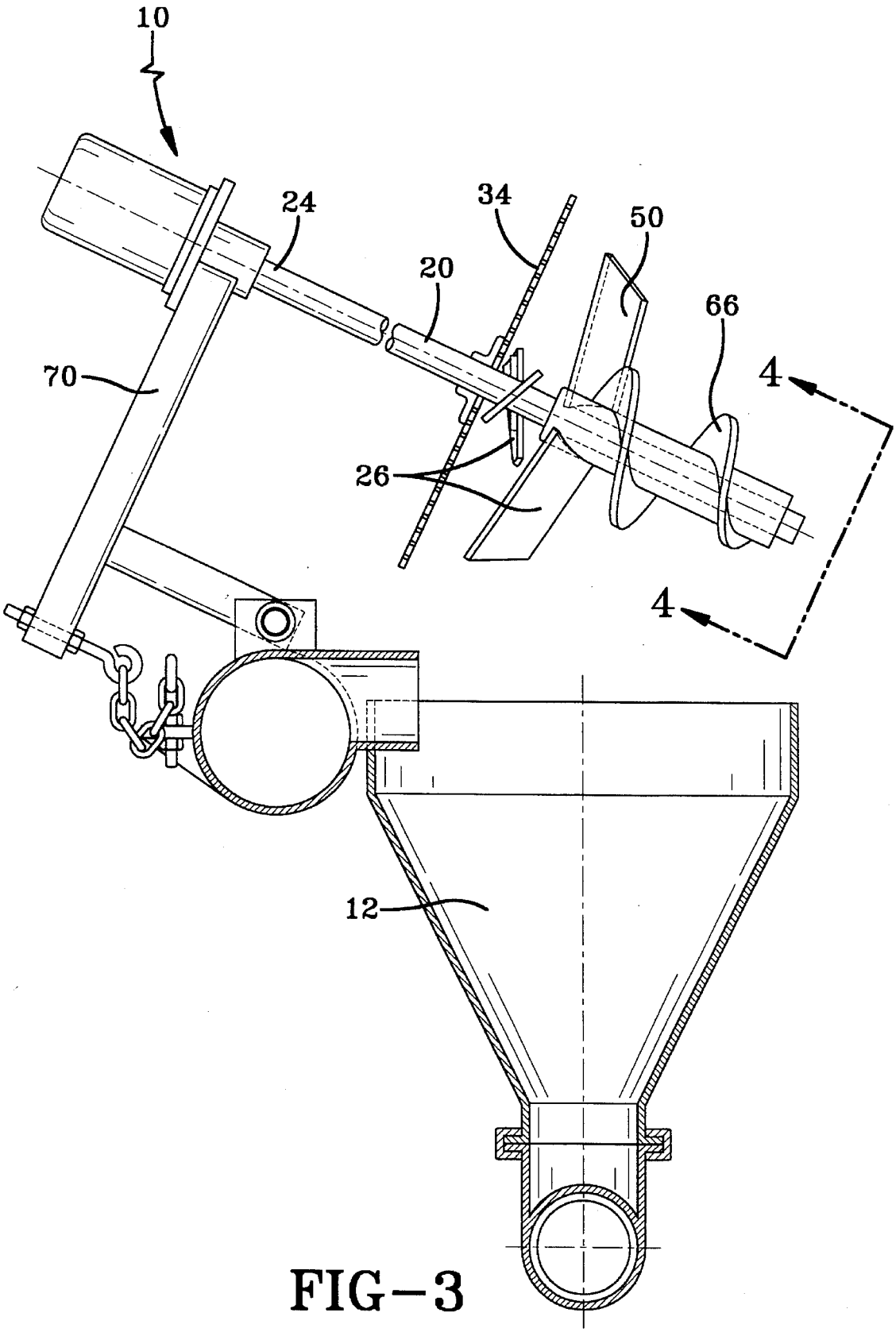
FIG. 3 shows a side view of the charging apparatus according to the invention.

With reference to FIG. 3, a preferred embodiment of the invention further comprises a hinged arm 70 located at the second end 24 of the shaft 20. The purpose of the hinged arm 70 is to allow the removal of the shaft 20 from within the receptacle 12. Access to the screen 34, second blades 58, first blades 50 and helical appendage 66 for removal, maintenance or cleaning is thus provided.

Figure 4:
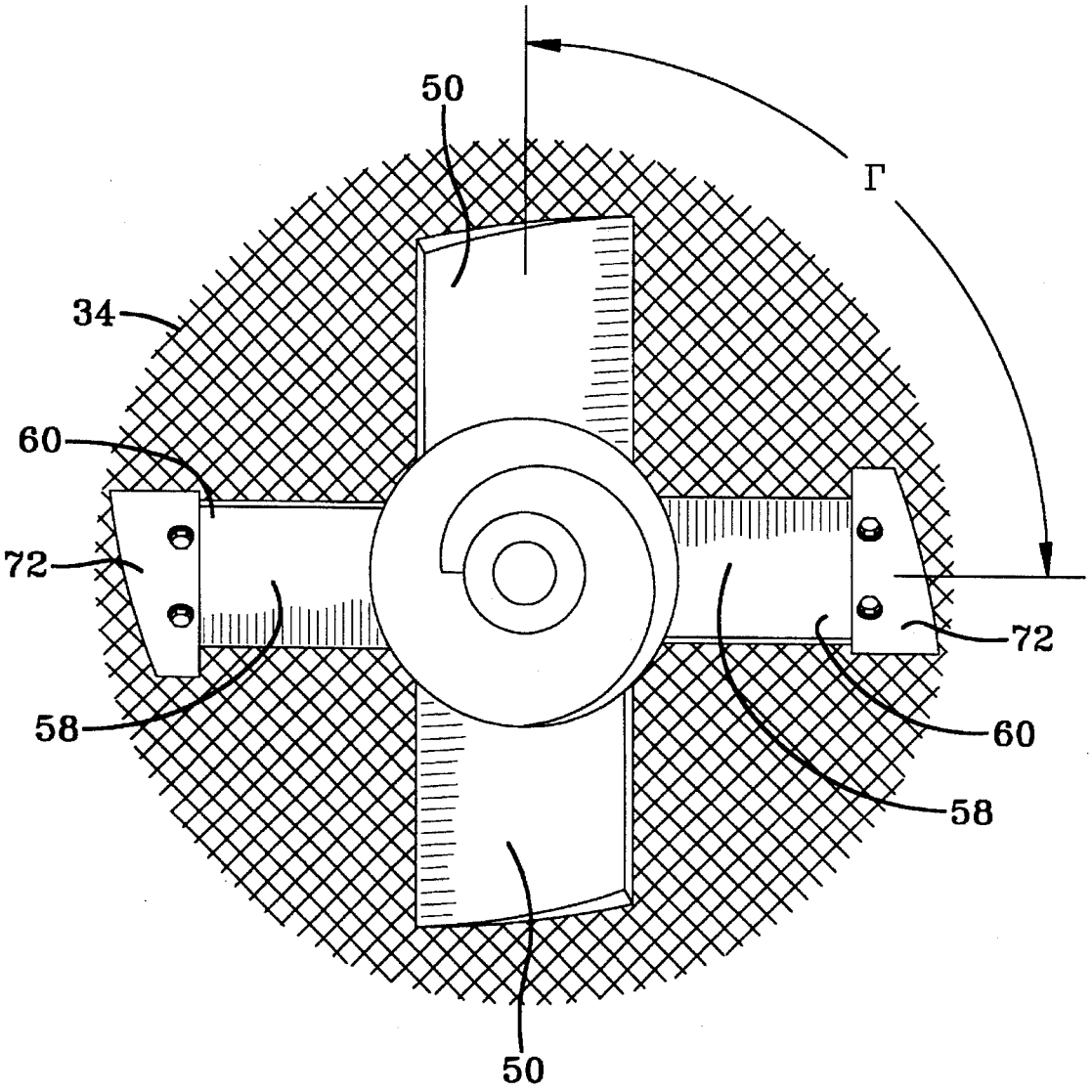
FIG. 4 is an end view of the shaft shown in FIG. 3 taken along the line 4—4.

FIG. 4 shows an end view of the shaft 20. First blades 50 and second blades 58 are offset by an angle $\Gamma$. Angle $\Gamma$ may range in values from 60° to 120°. In a preferred embodiment, angle $\Gamma$ measures 90°. The distal ends 60 of second blades 58 are closely received to the screen 34. In a preferred embodiment, the distal ends 60 are capped with rubber tips 72 to prevent wear on the blades 58 due to any buckling of the screen 34 caused by the slurry mixture.

The present invention has been described with reference to the preferred embodiment. Obviously, modifications and alterations will occur to others upon a reading and understanding of the specification. It is intended by the applicant to include all such modifications and alterations insofar as they come within the scope of the appended claims or the equivalents thereof.

Having thus described the invention, it is now claimed:

What is claimed is:

1. An apparatus for charging a pumping device with a slurry mixture, said apparatus comprising:

a hollow receptacle for receiving said slurry mixture, said receptacle being symmetric about a central axis, said central axis being vertical, said receptacle having first and second concentric edges, said first edge communicating with said pumping device;

a shaft, said shaft being coincident with said central axis, said shaft having first and second ends, said first end being received within said receptacle, said second end extending beyond said second edge, said shaft comprising a plurality of protrusions extending radially therefrom;

a rotating means for rotating said shaft;

said receptacle further comprising a conical configuration having a largest circumference at said second edge and an inwardly sloped wall; and, said plurality of protrusions comprising two first blades, said first blades being received within said receptacle, said first blades being oppositely pitched with respect to an angle each of said blades makes with said central axis, said first blades occupying opposing positions on said shaft, each of said first blades having a distal end, said distal ends being closely received to said wall and sloped to correspond therewith.

2. The apparatus of claim 1 wherein said plurality of protrusions further comprises:

two second blades, said second blades being received within said receptacle and located between said first blades and said second edge, said second blades being oppositely pitched with respect to an angle each of said second blades makes with said central axis, said second blades occupying opposing positions on said shaft, said positions of said second blades being offset by an angle with respect to said positions of said first blades, each of said second blades having a distal end.

3. The apparatus of claim 2 wherein said angle measures between 60° and 120°.

4. The apparatus of claim 2 wherein said angle measures 90°.

5. The apparatus of claim 2 further comprising an appendage, said appendage being attached to said first end of said shaft.

6. The apparatus of claim 5 wherein said appendage is helical, said helical appendage being twisted about said first end.

7. The apparatus of claim 5 further comprising a rigid screen, said screen being fixed to said shaft between said second blades and said second edge.

8. The apparatus of claim 7 further comprising a stationary scraper, said scraper extending from said second edge, said scraper contacting said upper surface of said screen.

9. The apparatus of claim 7 wherein said distal ends of said second blades comprise rubber caps.

10. The apparatus of claim 5 further comprising a hinged arm, said hinged arm being located at said second end of said shaft.

11. The apparatus of claim 5 further comprising a feed tube, said feed tube being closely received to said second edge for supplying said receptacle with said slurry mixture.

12. The apparatus of claim 5 further comprising a secondary feed tube, said secondary tube being extending from said wall, said wall having a hole communicating with said secondary tube for supplying said receptacle with said slurry mixture.

13. The apparatus of claim 2 further comprising a rigid screen, said screen being fixed to said shaft between said second blades and said second edge.

14. The apparatus of claim 13 further comprising a stationary scraper, said scraper extending from said second edge, said scraper contacting said upper surface of said screen.

15. The apparatus of claim 2 further comprising a hinged arm, said hinged arm being located at said second end of said shaft.

16. The apparatus of claim 2 further comprising a feed tube, said feed tube being closely received to said second edge for supplying said receptacle with said slurry mixture.

17. The apparatus of claim 2 further comprising a secondary feed tube, said secondary tube extending from said wall, said wall having an opening therein, said opening communicating with said secondary tube for supplying said receptacle with said slurry mixture.

18. The apparatus of claim 1 further comprising an appendage, said appendage being attached to said first end of said shaft.

19. The apparatus of claim 18 wherein said appendage is helical, said helical appendage being twisted about said first end.

20. The apparatus of claim 1 wherein said rotating means is an hydraulic motor, said motor being placed at said second end of said shaft.

* * * * *